US006701669B1

(12) United States Patent
Yorgason

(10) Patent No.: US 6,701,669 B1
(45) Date of Patent: Mar. 9, 2004

(54) SHUTTER SYSTEM ROTATION MECHANISM

(76) Inventor: Kim Charles Yorgason, 151 Grulla Ct., Norco, CA (US) 92860

( * ) Notice: Subject to any disclaimer, the term of this patent is extended or adjusted under 35 U.S.C. 154(b) by 0 days.

(21) Appl. No.: 10/241,089

(22) Filed: Sep. 10, 2002

(51) Int. Cl.[7] ..... E06B 7/096
(52) U.S. Cl. ..... 49/82.1
(58) Field of Search ..... 49/82.1, 74.1, 49/87.1, 403

(56) References Cited

U.S. PATENT DOCUMENTS 5,216,837 A * 6/1993 Cleaver et al. ..... 49/82.1
6,145,251 A * 11/2000 Ricci ..... 49/82.1
6,453,972 B1 * 9/2002 Sher et al. ..... 49/74.1

* cited by examiner

*Primary Examiner*—Jerry Redman
(74) *Attorney, Agent, or Firm*—Donn K. Harms

(57) ABSTRACT

An improved louver rotation mechanism for use in a louvered shutter having a frame and a plurality of rotating louver rotationally engaged in the frame. The device features one or a plurality of rack gears slidably engaged in one of the vertical stiles of the frame. The racks are geared about their exterior sides to concurrently engage gears formed on the louver axles of the louvers and a geared knob assembly operatively mounted in the stile such that a twist of the handle of the knob assembly is communicated to at least one of the racks which in turn twists the louvers. When two racks are used of equal weight they function as a counter weight in their engagement with the louvers thereby stabilizing them. Optionally a brake mechanism may be included in the knob assembly to hold the louvers stationary and the brake mechanism may also function as a clutch to prevent damage to the louvers if force is applied to the louvers sufficient to overcome the clutch. Additionally, the louver axles may be cooperatively engaged with both stiles to prevent bowing of the stiles.

30 Claims, 13 Drawing Sheets

SHUTTER SYSTEM ROTATION MECHANISM

FIELD OF THE INVENTION

The herein disclosed device relates to window shutters. More particularly it relates to a device for the improved control and rotation of louvers mounted in window shutters for control of the light transmission through the window into a room. Such light transmission control is generally accomplished by the louvers being rotationally locatable between an open position substantially perpendicular to the window allowing maximum light transmission and a closed position substantially parallel to the window and overlapping whereby light transmission is minimized.

BACKGROUND OF THE INVENTION

Conventional window shutters are generally comprised of rectangular hinged panels that are sized to cooperatively engage with the window frames around a window opening. Such panels generally are formed about their perimeter using two vertical members known in the industry as stiles and two horizontal rails communicating with the vertical stiles. Operationally engaged to the panels, is a horizontal array of parallel overlapping louvers that can be rotated on axles or similar rotational attachments to the stiles. Adjustment of the rotational positioning of the louvers is conventionally accomplished by laterally translating a tilt rod which attaches to one front edge of each louver to thereby vertically rotate the louvers in their engagement with the stiles. All louvers so attached to the rod will thus rotate to substantially the same angle in relation to the window when the rod is translated and thus regulate the light transmission into the room through the change in size of the gaps formed between the louvers.

Louvers rotated in this fashion are however, easily rotated out of the desired position by gravity, vibration, or jarring, thus presenting a constant problem in the gaps therebetween becoming too large or too small to yield the desired light transmission into the room. The tilt rods also create a visual obstruction in the center of each panel and obstruct in the cleaning of the louvers by blocking access thereto. Further, even under the best conditions, positioning the louvers to the desired angle is hard to do since it involves the use of the hand and arm to move the tilt rod which can be hard to do especially for the aged or persons without adequate manual dexterity.

U.S. Pat. No. 5,469,658 (Digianni) attempts to solve the problem inherent to rod rotated louvers by using a gear train Which engages the louvers such that the user moves one louver to move them all. However Digianni is still easily moved from proper adjustment by vibration or abrasion and requires the user to grab a louver to adjust the device increasing the likelihood of louvers getting dirty or damaged.

U.S. Pat. No. 2,652,245 (Bentley) teaches a mechanism for opening and closing louvers which uses a plurality of cables to rotate a plurality of louvers. However, Bentley is complicated to assemble and somewhat unsightly due to the cables which would be easily kinked over long periods of use.

U.S. Pat. No. 2,272,722 (Morin) discloses a worm gear driven device for rotation of windows. As disclosed however, Morin is not easily constructed due to the need to align worm and communicating gears and also requires the use of yokes and other devices for use.

As such, there is a pressing need for a louver adjustment system that is easily constructed and functions without a great need for adjustment or service. Such a device should provide for the elimination of the conventional and unsightly tilt rod. Such an adjustment system should maintain the louvers in the user desired position and should not be easily affected by gravity, vibration, or jarring. Still further, such a louver adjusting system should be easy to adjust even in minute amounts to provide the optimum amount of light through the gaps between the louvers for the user.

SUMMARY OF THE INVENTION

The above problems, and others are overcome by the herein disclosed louver rotation system. As herein described the device allows for rotation of louvers within a shutter panel without the need or use of an exterior tilt rod. Instead, a knob communicating internally with a pair of reciprocating gears through one of the panels stiles, imparts louver rotation when the rotation of the knob translates a pair of elongated geared racks which in turn, communicate that rotation to operatively communicating gears on the louvers.

Once rotated to the desired position, the louvers are maintained by in that position by the herein disclosed device through a number of design factors. First, the louvers all communicate with a pair of the geared racks in a balanced engagement with one rack engaging the gears on the louvers balanced by the force from the other. Additionally, in one preferred embodiment, a clutch or brake mechanism is provided wherein resistance to rotation is imparted by the knob assembly. This clutch type pressure makes the louvers generally resistive to movement since the racks engaging the gears on the louvers are impeded in their translation due to the clutch pressure. However, should the louvers be somehow jarred, slippage will occur in the knob assembly allowing the louvers to rotate and avoiding damage to the system.

Also, the device has no asymmetrical components like the conventional tilt rod, to create downward pull on the louvers. Communication of knob rotation, and movement of all louvers is provided by the two geared racks with double gear faces and diagonal configuration. Additional utility is provided by the double gear and rack design which not only eliminates any possibility of gear slippage, the two racks acting as counter balance to each other thereby provide a means to maintain the louvers in the selected horizontal position by preventing rotation from vibration or gravity.

Further utility in the disclosed device herein is provided by the use of a gear channel insert to house the geared racks which provides for a smoother operation of the racks. Optional connector ends on the geared racks may also be configured to cooperatively engage similar geared racks and thereby allow for the elongation of the geared racks for taller louvered shutters and modular construction of louvered shutters using prefabricated components to assemble the stiles, ends, louvers, and gear mechanism into an operating louvered shutter. Consequently the geared racks can either be manufactured as one piece to fit the specific shutter being made in cooperative engagement with channel inserts also properly sized for that shutter or in standard lengths which can be assembled to fit a desired length of a shutter frame.

Accordingly, it is the object of this invention claimed herein to provide a simplified louvered shutter design which is easily operated and adjusted by the user.

It is another object of this invention to supply a louvered shutter system that resists mis-adjustment through the use of balanced components.

It is still another object of this invention to supply a louvered shutter system that will maintain the louvers in the position set by the user with a simple clutch mechanism.

It is a still further object of this invention to provide for the elimination of problems inherent with the tilt rod in a louvered shutter system.

It is yet another object of this invention to provide a louvered shutter that is easily cleaned and provides a view through the louvers that is unobstructed by vertical tilt rods.

A further object of this invention is the provision of geared components and channel inserts that may be assembled and provide for modular assembly of shutters.

Further objectives of this invention will be brought out in the following part of the specification, wherein detailed description is for the purpose of fully disclosing the invention without placing limitations thereon.

BRIEF DESCRIPTION OF THE DRAWING FIGURES

The accompanying drawings which are incorporated in and form a part of this specification illustrate embodiments of the disclosed device and together with the description, serve to explain the principles of the invention.

DETAILED DESCRIPTION OF THE PREFERRED EMBODIMENTS OF THE DISCLOSED DEVICE

Figure 1:
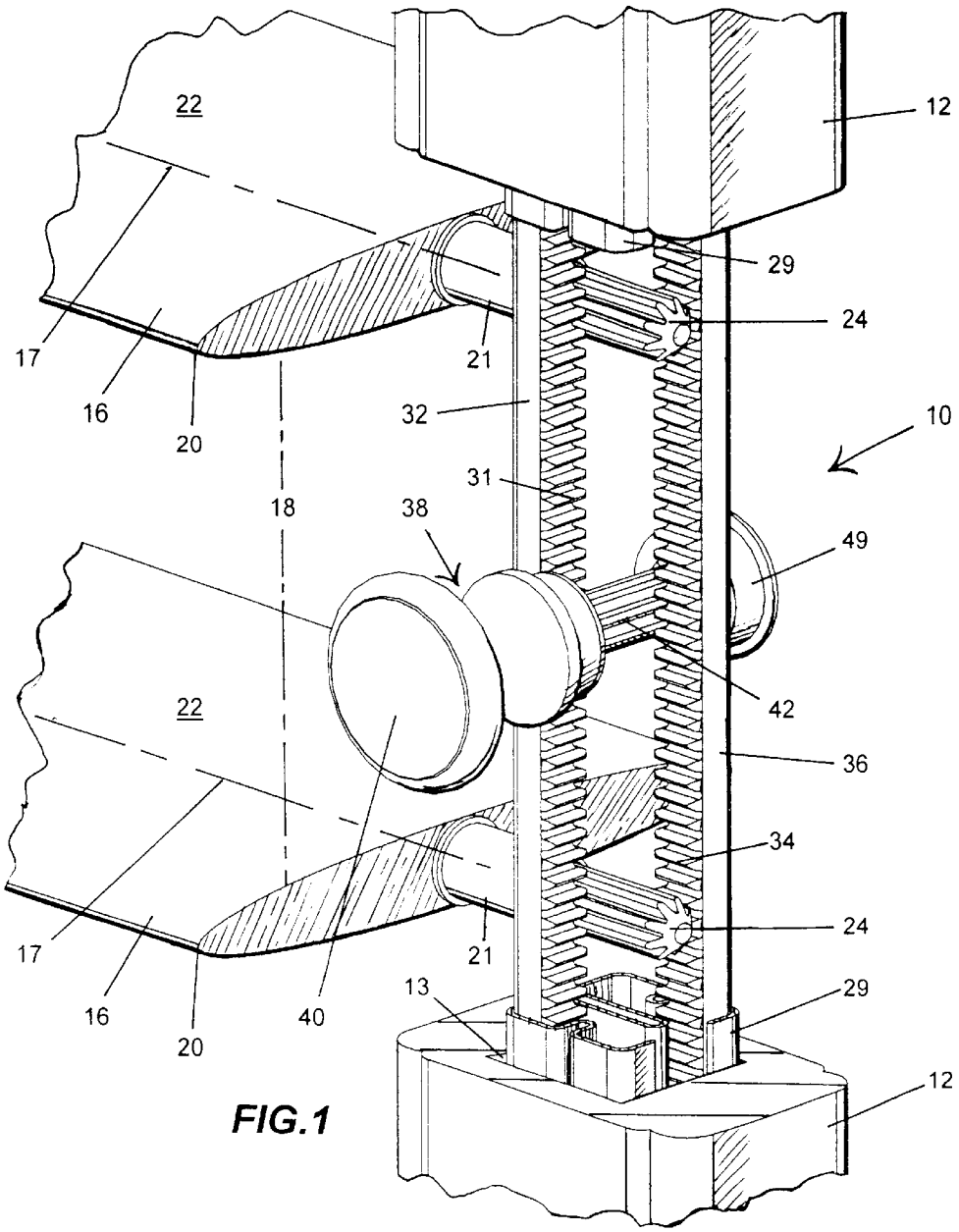
FIG. 1 depicts a perspective view of the cooperative engagement of louver-mounted gears with both racks which are operatively engaged within a stile mounted insert.
Figure 2:
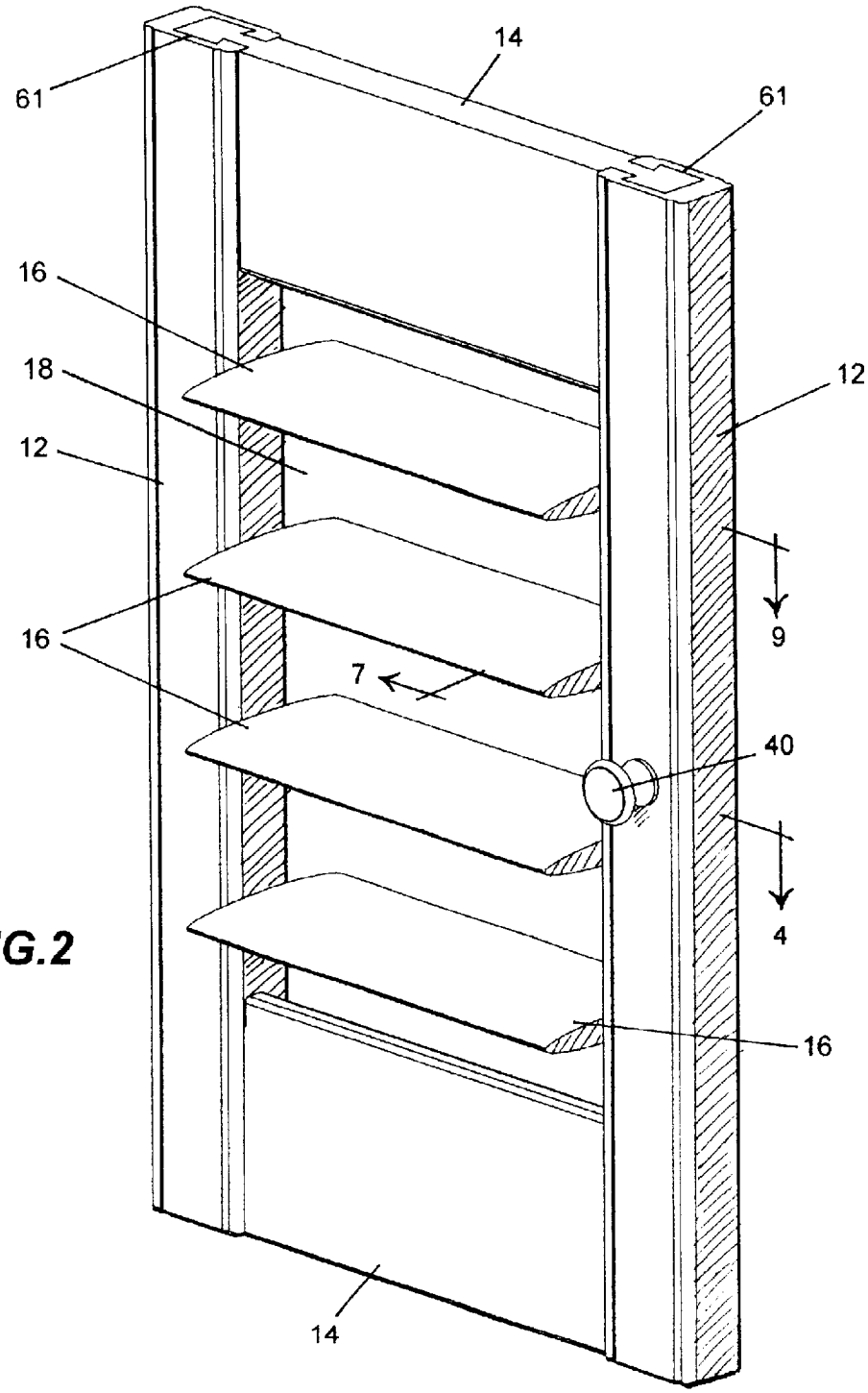
FIG. 2 shows a perspective view of the exterior of a shutter using the herein disclosed system.
Figure 3:
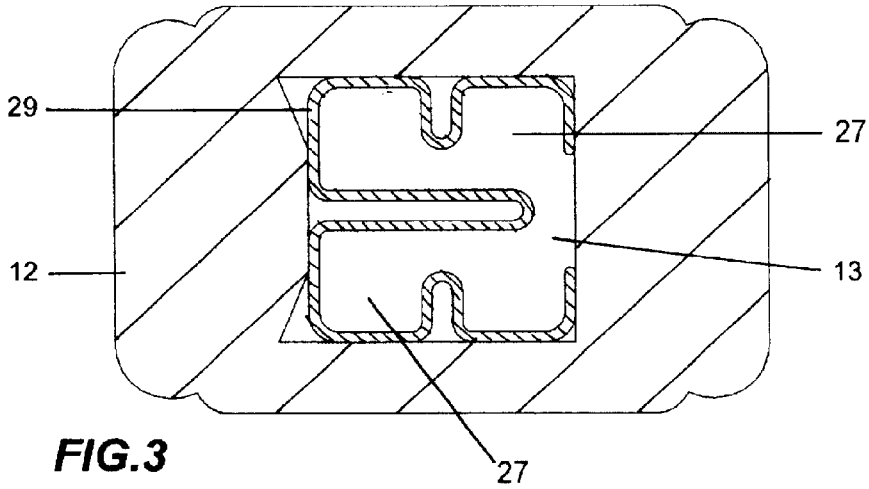
FIG. 3 depicts a top view of the stile showing gear channel inserts having channels dimensioned for lateral translation of the racks therein.

Referring now to FIGS. 1–24 which depict the current best mode and preferred embodiments of the device 10. FIG. 1 depicts a perspective cut away view of an assembled preferred embodiment of the device 10 showing one of the two sides of a frame formed by stiles 12 connected together by horizontal rails 14. The assembled device 10 is depicted in FIG. 2. The device 10 would have one stile 12 which operatively engages one side of the louvers 16 for imparting rotation thereto and the other stile 12 providing support to the opposite end of the louvers 16. As best shown in FIG. 3, the stile 12, which operatively engages the louvers 16 in the current best mode of the device, has an insert channel 13 formed to accommodate the operative mounting of a channel insert 29. An additional function of the channel insert 29, especially when formed of metal or strong plastic in the serpentine shape shown in FIG. 3, is to provide extra strength to the stile 12 into which it cooperatively engages. Of course those skilled in the art will recognize that other shapes might be used for the channel insert 29 and such are anticipated in the scope of this invention. This channel insert 29 can be extruded from plastic or metal or might also be formed of sheet metal to the proper dimensions to accommodate the laterally translating racks 32 and 36.

A plurality of louvers 16 are rotationally mounted in the frame, shown in FIG. 2, such that they may rotate to a position overlapping each other in the conventional fashion that allows them to block light through the device 10 or be rotated to angles to form gaps 18 between the louvers 16. The size of these gaps 18 and thus the light transmitted from outside into the room through the device 10 is determined by the angle at which the louvers 16 are positioned in relation to the plane of the window adjacent to the device 10 and the angle of the sun outside the window.

With the louvers 16 substantially perpendicular to the adjacent vertical window and forming the largest gap 18 there between, visual obstruction is minimized to the user since only the thin louver side edges 20 are positioned to block the view. Conversely, when the louvers 16 are angled at a position other than perpendicular in relation to the adjacent window, the large side surfaces 22 obstruct the view with total obstruction occurring when the louvers 16 are rotated to a position where the side surfaces 22 overlap and remove any gap 18 from in between the louvers 16.

Since accurate adjustment of the angle of the louvers 16 is important to achieving the desired amount of light transmission through the device 10 it is highly desirable that the rotation of the louvers 16 be easily controlled to achieve the desired effect and that the louvers 16 maintain their adjusted position. Further, it is important to maintain all of the plurality of louvers 16 in the assembled device 10 at substantially the same angle in relation to the adjacent window and parallel to each other, and to keep the louvers 16 at that desired angle until the user decides to change it and the resulting size of the gaps 18 between the louvers 16.

Figure 9:
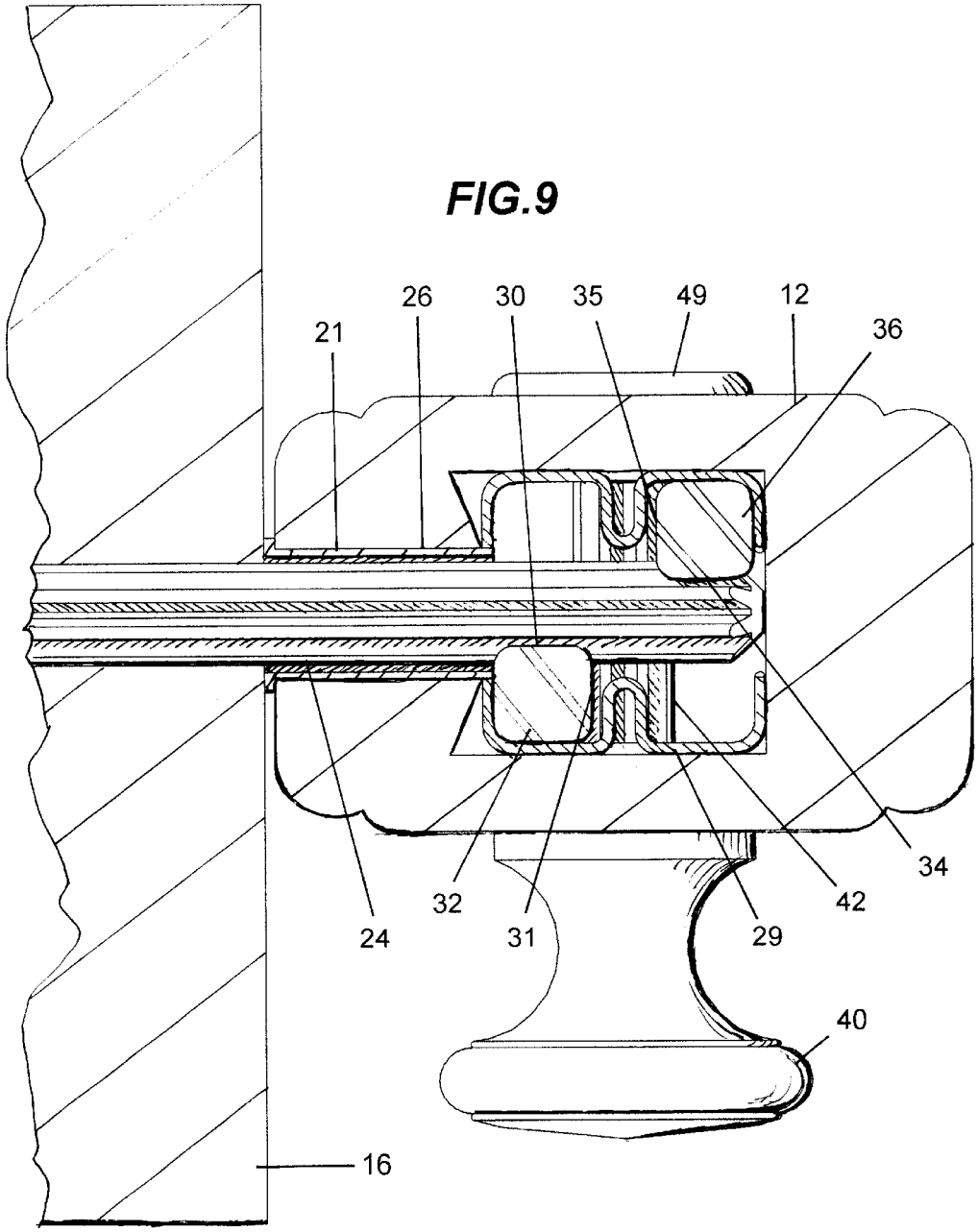
FIG. 9 is a top end view of the stile showing the cooperative engagement of the louver axle with both gear racks which are operatively engaged in channels formed in a gear channel insert.
Figure 10:
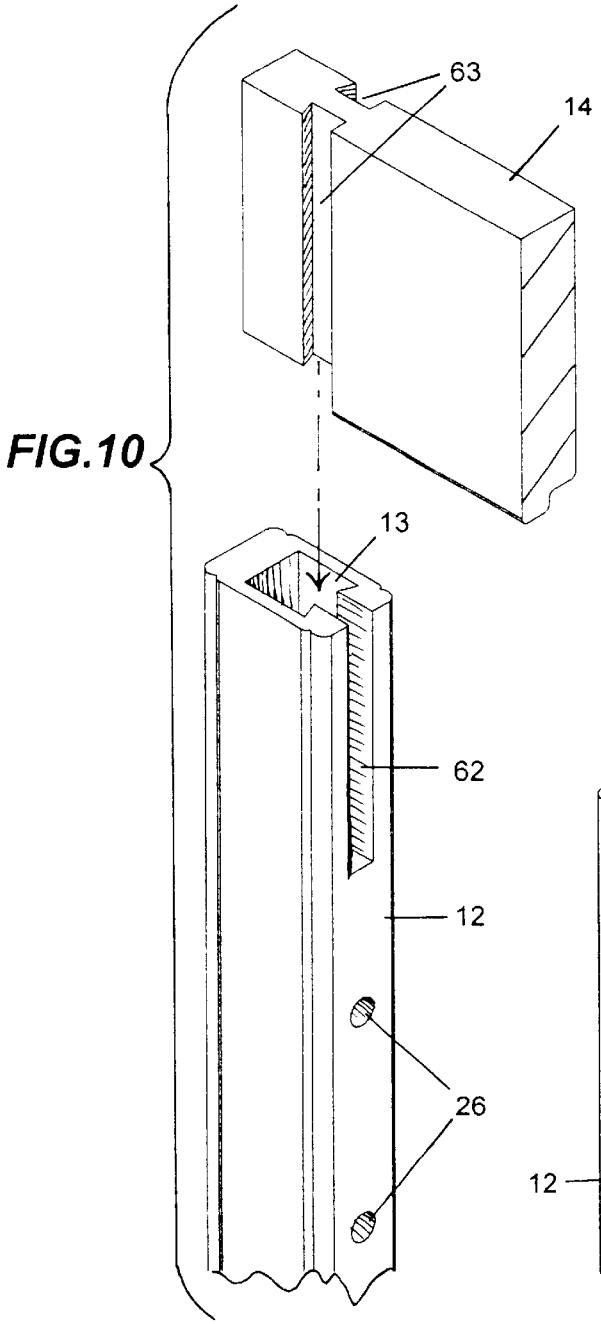
FIG. 10 depicts an exploded view of a preferred means for cooperative engagement of the stiles and rails.
Figure 11:
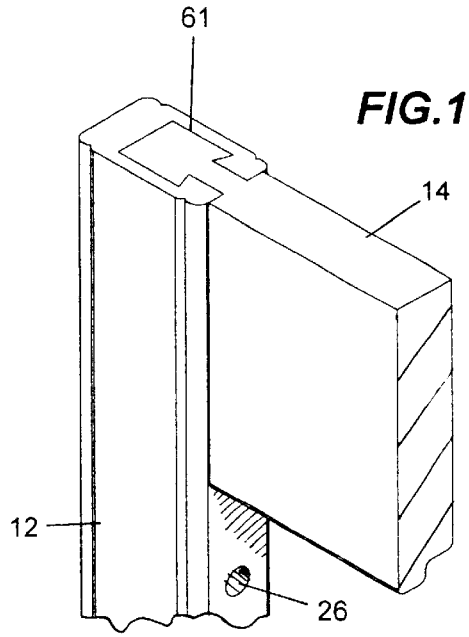
FIG. 11 shows an engaged stile and rail of FIG. 10.

As shown in FIG. 1 each louver 16 is attached to a louver axle 24 which projects from both ends of the louver 16 substantially at the center axis 17 of the louver 16 to allow for even rotation of the louver 16 about the center axis 17 and to concurrently provide substantially parallel positioning of one louver 16 in relation to all of the other louvers 16 in the assembled device 10. The louver axles 24 may extend through the entire louver 16 for extra support or it could just communicate into the ends of the louver 16 should the extra support not be desired. The louver axle 24 protruding at both ends of the louver 16 is rotationally engaged into channels 26 formed in both stiles 12, as illustrated in FIGS. 9–11. These channels 26 are dimensioned for operative rotational engagement with the exterior circumference of the louver axles 24 such that the attached louvers 16 will easily rotate in position within the stiles 12 of the frame formed by the stiles 12 and rails 14 connecting them. Alternatively and in the current best embodiment, louver axle bushings 21 would be engaged within the insertion channels 26 and the louver axles 24 would rotate therein during operation of the device 10. These louver axle bushings 21 would provide the best mount and guide for the exterior of the rotating louver axles 24. However, the louver axles 24 might also just rotate in the insertion channels 26 and such is anticipated.

Figure 8:
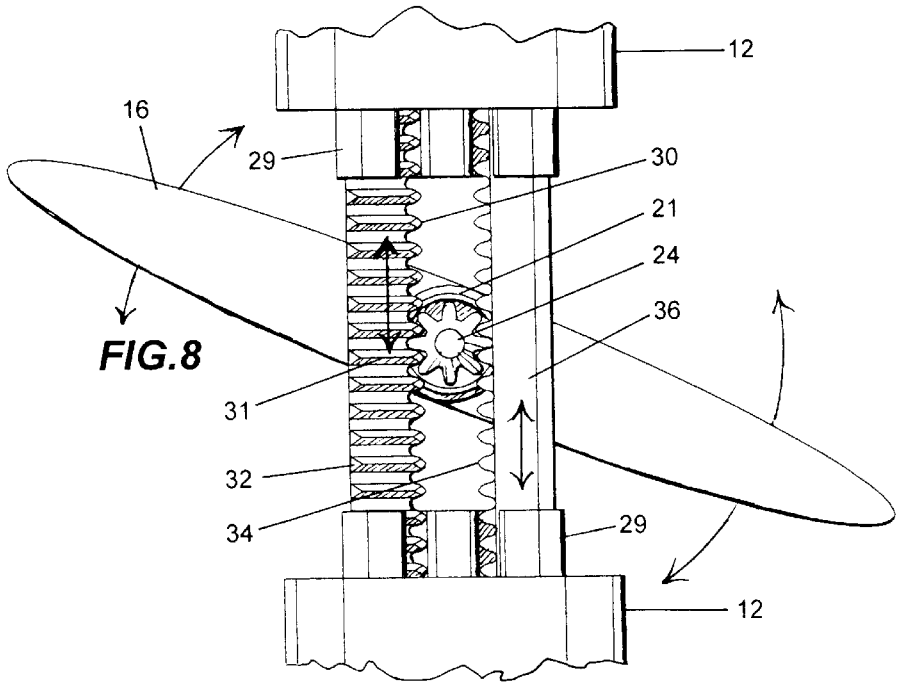
FIG. 8 depicts an end view of a louver with a louver axle engaged with the axle channel and both gear racks.

As it is highly desirable to have all of the louvers 16 move together and equally when adjusting the gap size 18 between the louvers 16, which is best shown in FIG. 2, a means to maintain the louvers 16 substantially parallel to each other is provided by the surface of the exterior of at least the one louver axle 24 engaged with each louver 16 on one side of each respective louver 16. The distal end of the louver axle 24 would have a geared surface which engages laterally translating rack gears operatively mounted in one stile 12. The louver axles 24 on the opposite side need only be operationally engaged with the opposite stile 12 in the insertion channel 26 or the insertion channel 26 engaged axle busing 21 in the aforementioned fashion. The gear shape formed on the circumference of the louver axle 24 cooperatively engages with a first gear face 30 as shown in FIG. 8, on a first rack gear 32 and also with a first geared surface 34 on a second rack gear 36 in the preferred embodiment of the device 10. As a result, if the louver axles 24, communicating with each of the respective louvers 16, are initially engaged with the first rack gear 32 and second rack gear 36, when the louvers 16 are in a substantially parallel position to each other, all of the louvers 16 remain substantially parallel no matter what angle they are rotated to by the lateral translation of the first rack gear 32 on one side of the louver axle 24 and the concurrent and opposite lateral translation of the second rack gear 36 engaged with the opposite side of the louver axle 24.

In a current preferred embodiment of the device 10 both the first rack gear 32 and second rack gear 36 are best engaged in channels 27 which are formed in a channel insert 29 which is mounted in an insert channel 13 formed in the stile 12, as best seen in FIG. 3. The provision of the channel insert 29 provides for easier manufacture of the device 10 and the use of metal or plastic for the channel insert 29 which would be better to cooperatively engage with the first rack gear 32 and second rack gear 36 which would be made from a metal or plastic material to best engage and translate in the material forming the channel insert 29. However, channels 27 could also be formed in the stile 12 itself as shown in a four channel stile 11 and a two channel stile 15 in FIGS. 15–16 to house and accommodate the lateral translation of the first rack gear 32 and second rack gear 36 and still yield a major advancement over the art and such is anticipated. Or, the channels 27 might also be defined inside the stile 12 by other means of defining a straight guide channel such as providing a plurality of inserts that would be mounted into the stile 12 adjacent to the louver axles 24 with each having passages therethrough aligned to form the channels 27 to provide a guide for the lateral translation of the first rack gear 32 and second rack gear 37 inside the stile 12. However the current best mode uses either the channel insert 29 or forms the channels 27 in the stile 12 itself.

Figure 4:
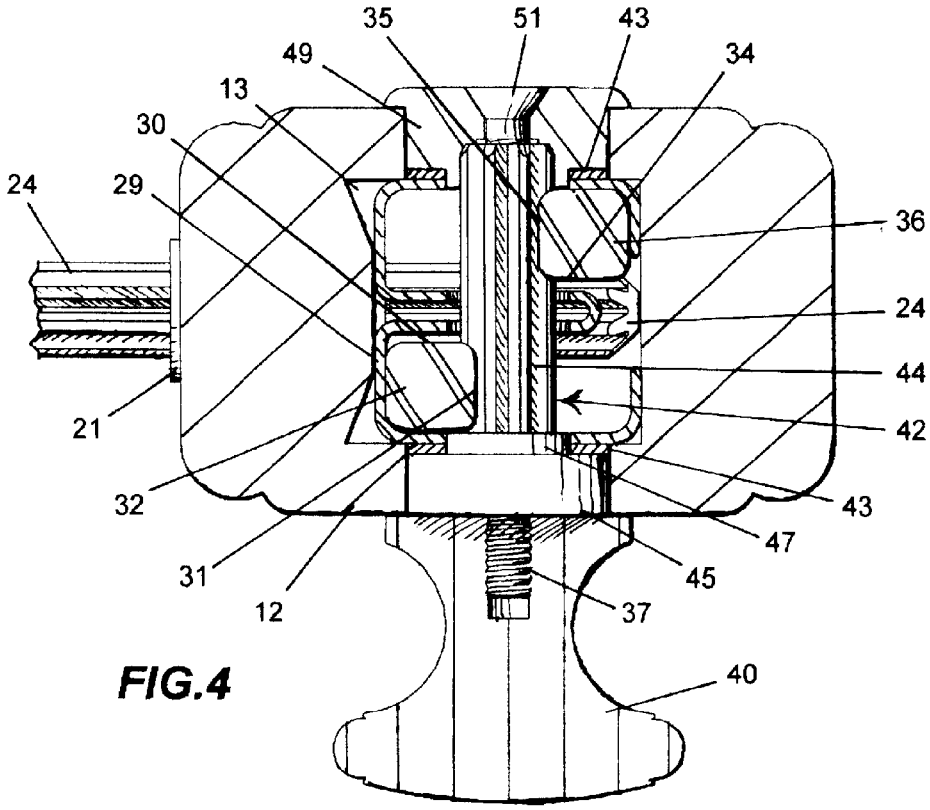
FIG. 4 is a top end view of the stile showing the engagement of the gear communicating with the end of a louver and the second two geared sides of the racks which are engaged with a knob stem.
Figure 5:
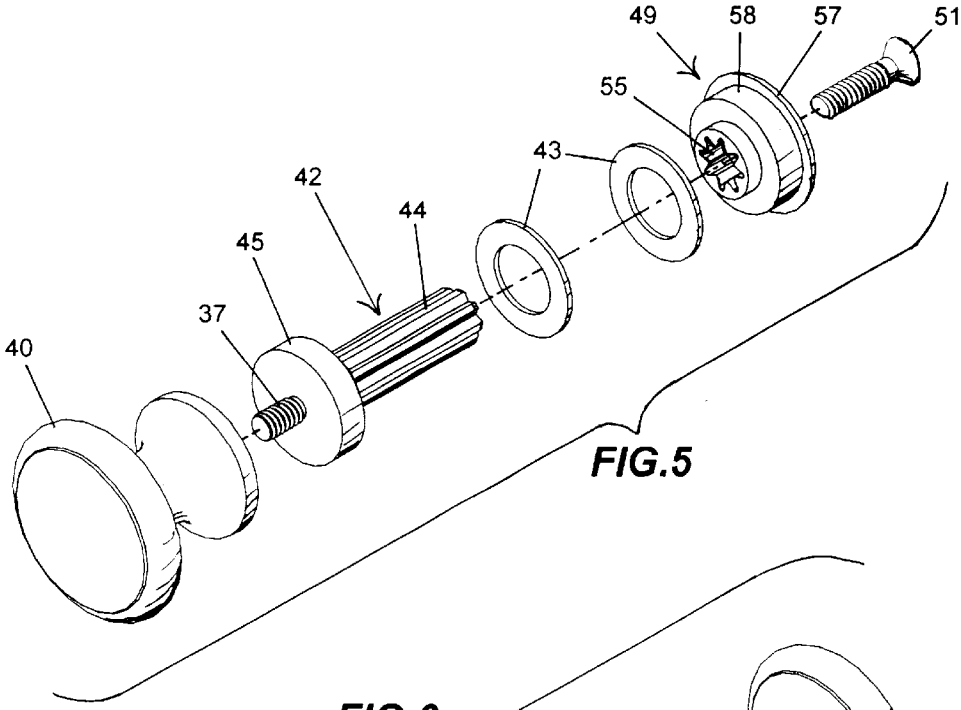
FIG. 5 depicts an exploded view of the knob assembly.
Figure 6:
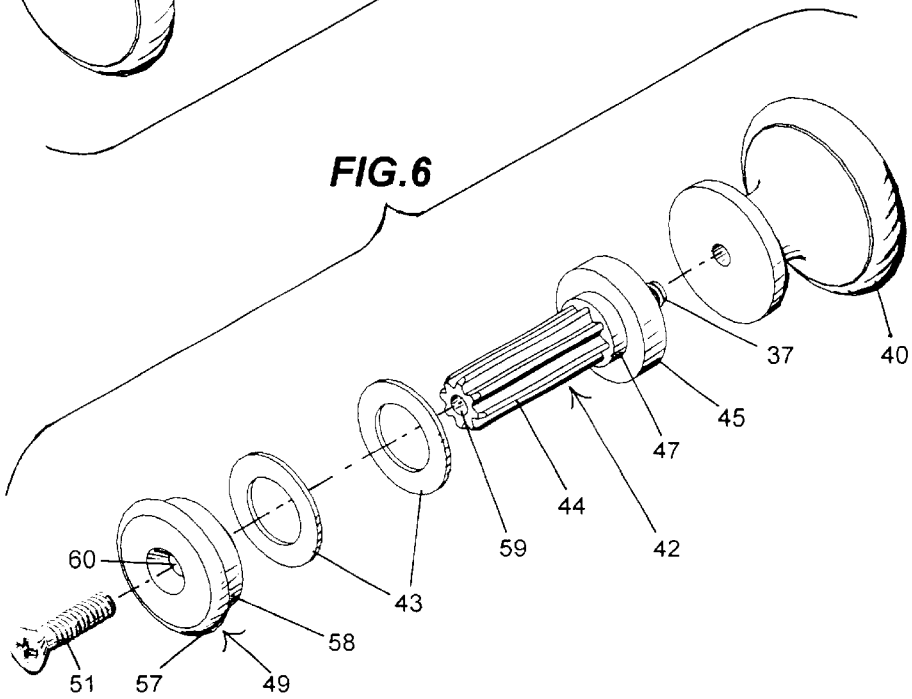
FIG. 6 depicts an exploded view of the knob assembly from the opposite view of FIG. 5.

Lateral translation of both the first rack gear 32 and second rack gear 36 in opposite directions inside the channel insert 29 in the current best mode is accomplished using a knob assembly 38 having a handle 40 engaged with a knob stem 42 either directly or on a threaded shaft 37 attached to the knob stem 42 as seen in FIGS. 5–6. The knob stem 42 has gear teeth 44 formed about the circumference of the center the knob stem 42. The gear teeth 44 are dimensioned to cooperatively engage with the second gear face 31 of the first gear rack 32 and an concurrently with a second geared surface 35 of the second gear rack 36 as seen in FIG. 4. As best shown in FIGS. 4–6, when the communicating handle 40 is twisted, it thus twists the gear teeth 44 formed on the knob stem 42 which laterally translate the engaged first rack 32 and second rack 36 in opposite directions and thereby rotate the louver axle 24 engaged on opposite sides by the first rack gear 32 and second rack gear 36. A twist of the handle 40 thus rotates all of the louvers 16 evenly maintaining them parallel to each other during their rotation.

Figure 7:
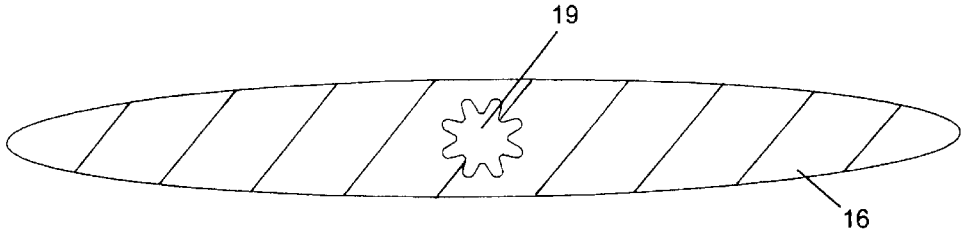
FIG. 7 shows an end view of a louver having an internal axle channel formed therein.

An additional benefit is derived from the use of both the first rack gear 32 and second rack gear 36 having substantially equal weights, to rotate and maintain the louvers in positions. As shown in FIGS. 7–8, the engagement of the first rack gear 32 on a first side of the geared surface of the louver axle 24 and the engagement of the second rack gear 36 with the opposite side of the louver axle 24, a balanced force from gravity acting upon the equal weight of both rack gears 32 and 36 is continually imparted in both directions to the louver axle 24 thereby encouraging the louver axle 24 and connected louvers 16 to remain motionless especially when the device 10 is affected by bumping or vibration.

Another preferred embodiment of the device 10 disclosed herein might also have only one rack gear such as the first rack gear 32 engaged with the geared exterior end of the louver axle 24 and the gear teeth 44 of the knob assembly, while still providing an improvement on current devices available, and such is anticipated, However, the current best preferred mode features two rack gears.

In a preferred embodiment of the device 10 a knob assembly 38 configuration is provided which would allow for easy replacement of the knob 40 as well as internal parts should wear arise. A means to brake the lateral translation of the rack gears is also provided. As shown in FIGS. 4–6 the handle 40 would threadably engaged with a threaded shaft 37 communicating with a first end of the knob stem 42, or otherwise be operatively mounted thereon. Also at this first end would be an outer axle 45 sized to operatively rotate in an appropriately dimensioned recess in the stile 12 and an inner axle 47 sized to operatively rotate in an appropriately dimensioned hole in the stile channel insert 29. On the opposite end of the knob stem 42 an inner flange 58 of the knob hub 49 would be dimensioned for cooperative engagement with a recess in the stile 12 with an outer flange 57 sized slightly larger that this recess. At least one washer 43 would provide a vertical rotating surface between holes in the stile channel insert 29 and both the outer axle 45 and the knob hub inner flange 58. A sleeve 55 is formed in the knob hub 49 and dimensioned to cooperatively engage the knob stem 42. A screw 51 would be loosely inserted through a knob hub channel 60 and would be threadably engaged with a stem channel 59 axially located in the knob stem 42. This entire knob assembly 38 can be easily installed with both rack gears in place inside the stile 12. An additional benefit provided by this preferred embodiment of the knob assembly 38 is the ability to adjust the torque engagement of the screw 51 with the stem channel 59 such that pressure is imparted to the engagement of the outer axle 45 and knob hub 49 in their respective engagements in the stile 12. This adjustable pressure provides a means to brake the movement of the rack gears as well as a clutch means to provide for slippage of the rack gears upon impact to the louvers 16 to prevent damage.

Figure 12:
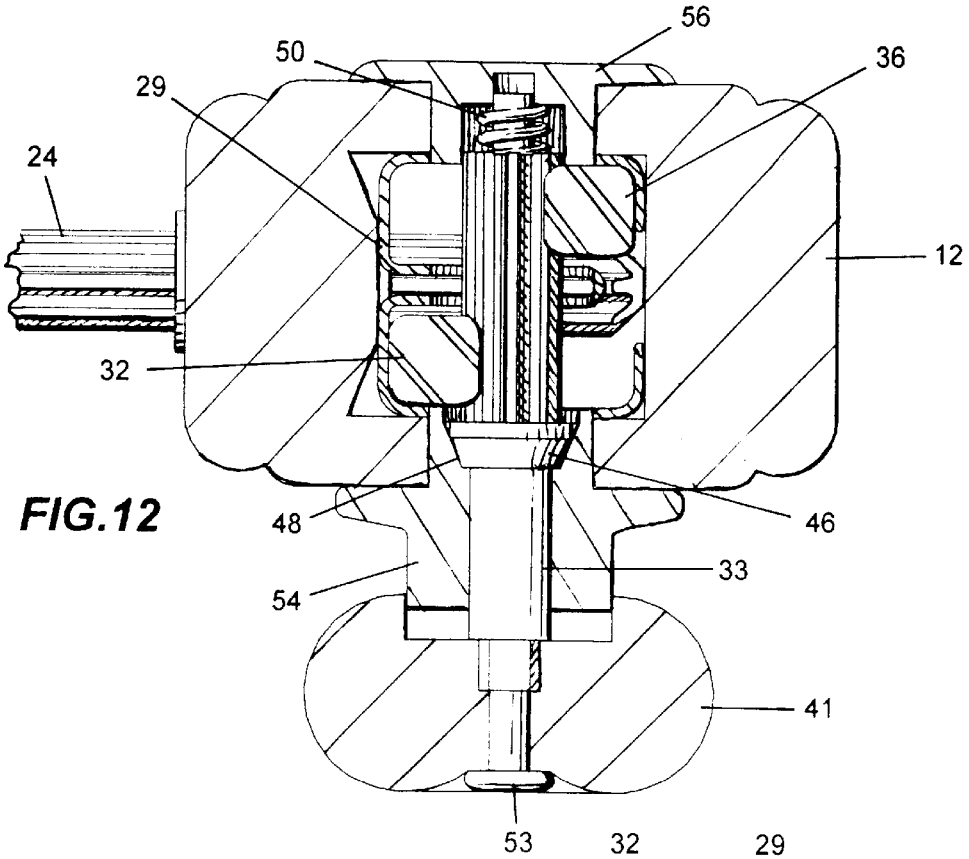
FIG. 12 is a top end view of an alternate embodiment of a knob assembly incorporating a clutch mechanism in the engaged position.
Figure 13:
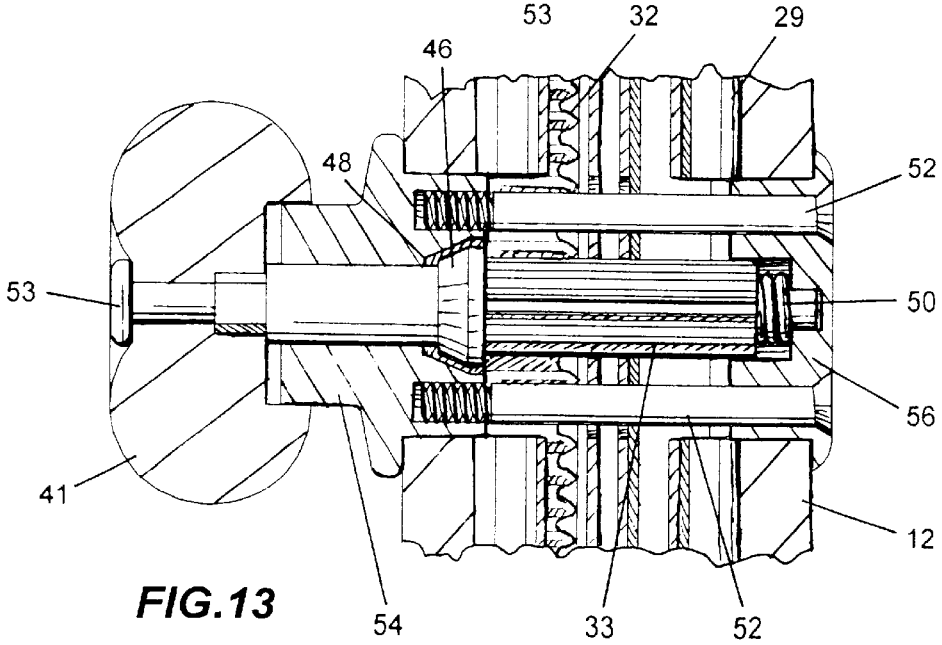
FIG. 13 depicts the knob assembly of FIG. 12 in a sectional view showing the clutch mechanism out of engagement.
Figure 14:
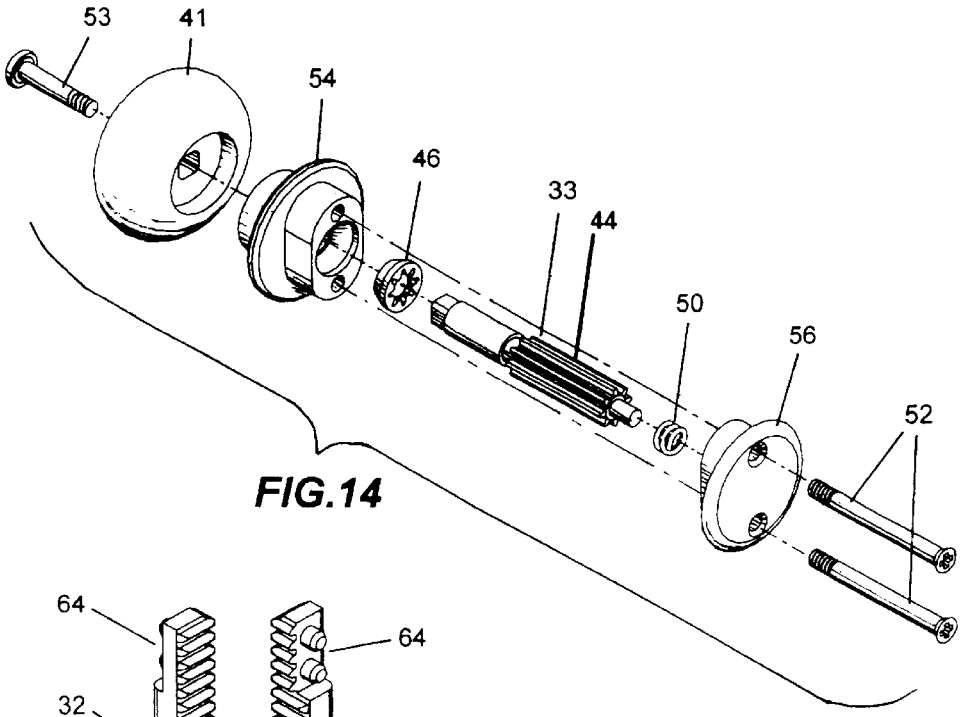
FIG. 14 shows an exploded view of the alternate preferred embodiment of the knob assembly of FIG. 12.
Figure 15:
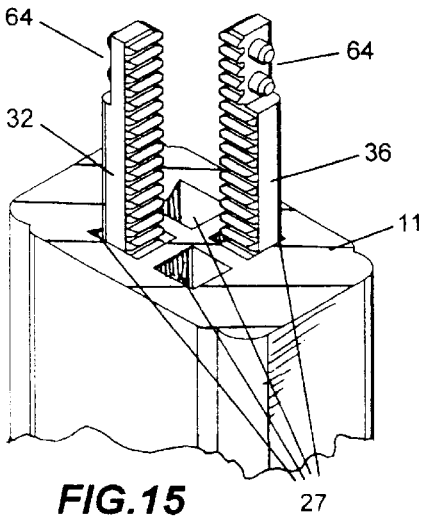
FIG. 15 depicts the pair of racks cooperatively engaged in two of four channels formed in the stile.
Figure 16:
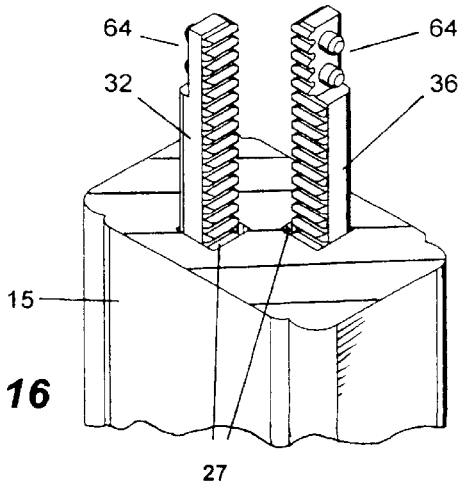
FIG. 16 shows an alternate embodiment of the racks engaged in two channels formed in the stile.
Figure 17:
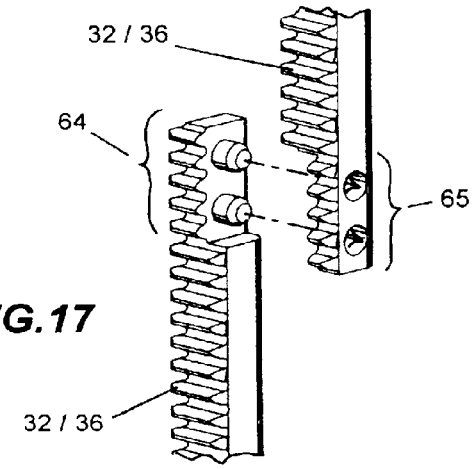
FIG. 17 depicts connector ends which may be formed on the racks as a means for assembly of racks from one or a plurality of rack components.
Figure 18:
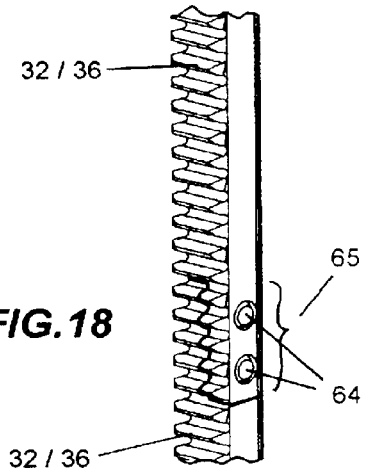
FIG. 18 is an assembled view of FIG. 17.

An alternate preferred embodiment of the knob assembly 38 of device 10 would have a positionable brake collar 46 included in the knob assembly 38 which would frictionally engage a braking surface 48 formed in the knob assembly 38 in a position to engage the brake collar 46 mounted on the alternative knob stem 33 and biased against the braking surface 48 by a biasing means communicating force to the brake collar 46 such as the depicted spring 50. As shown in FIGS. 12–14 the brake collar 46 is mounted about the knob stem 33 which laterally translates in this embodiment of the knob assembly 38. The spring 50 naturally biases the knob stem 33 and communicates that biasing force to the brake collar 46.which frictionally engages the brake surface 48. Using a biased brake to help maintain the louvers 16 in place not only maintains them in a steady user determined position chosen by the aforementioned rotation of the alternative handle 41, the brake collar 46 being in a frictional engagement with the brake surface 48 thereby provides a clutch means to prevent damage to the louvers 16 if they are struck with sufficient force to move them since there will be slippage between the brake surface 48 and brake collar 46 after sufficient force is imparted. If the louvers 16 were locked in position by a mechanical engaged lock, severe damage could result to the louvers 16 or gear train which is avoided by the brake collar 46 also operating as a clutch means. Those skilled in the art will no doubt recognize that other designs might function as a clutch means with the disclosed device 10 and such other clutch means are anticipated.

In using the alternative knob assembly 38 depicted in FIGS. 12–14, the user would depress or force the handle 41 toward the knob assembly's 38 mount on the stile 12. This force thereby depresses the spring 50 and laterally translates the alternative knob stem 33 to thereby disengage the brake collar 46 from its frictional biased engagement with the brake surface 48 of the knob assembly 38 and into a release position shown in FIG. 13. Once depressed the handle 41 is twisted in the aforementioned fashion to communicate rotation to the gear teeth on the knob stem 33 which in turn laterally translate both the first gear rack 32 and second gear rack 36 to rotate the lovers 16 to the desired position or angle. Once that determined position is reached, the user just needs to release the pressure used to depress the handle 41 which will cause the spring 50 to again bias the brake collar 46 into frictional engagement with the brake surface 48 formed adjacent thereto and into a stationary position, thereby holding the entire geartrain in place and fixing the louvers 16. The entire knob assembly 38 would be mounted in a conventional fashion using assembly screws 52 engaged through a rear casing 56 with the handle casing 54 positioned through an aperture communicating through the stile 12 in a position to provided the operative engagement of gear teeth 44 formed on the alternative knob stem 33 to engage with one or both gear racks 32 and 36 depending on the number chosen for construction of the device 10 with both being the current best mode due to the counter force and additional gear contact provided with two. The alternative knob 41 and knob stem 33 are cooperatively engaged with an attachment screw 53.

As the frames generally mount adjacent to windows and doors which have substantially perpendicular sides, it is highly desirable to maintain the stile 12 perpendicular to the rail 14 for the life of the device 10 for both aesthetic and functional reasons. A preferred means for cooperative engagement of the stiles 12 and rails 14 perpendicular to each other is best depicted in FIGS. 10–11 by stile joint 61. As shown, the rails 14 would have routing groves 63 dimensioned and positioned for cooperative frictional engagement with shoulders on a joint slot 62 formed in the stiles 12. In this fashion the frame could be easily assembled, and the elongated frictional engagement of the shoulders on the joint slot 62 within the routing groove 63 maintains the perpendicular engagement of the rail 14 to the stile 12 for the life of the device 10.

An optional embodiment of the device 10 would feature the means for cooperative engagement of a plurality of gear components to form the first rack gear 32 and second rack gear 36. In this embodiment shown in FIGS. 17–18, a first piece of rack gear having a recessed end portion with a male connector end 64 would be mated to a second piece of rack gear having a female end connector 65 to form a single rack gear shown in FIG. 18. This configuration would allow for assembly of the rack gears from a kit of smaller rack gear component pieces to form the appropriate desired length of rack gear for the first rack gear 32 or second rack gear 36.

Figure 19:
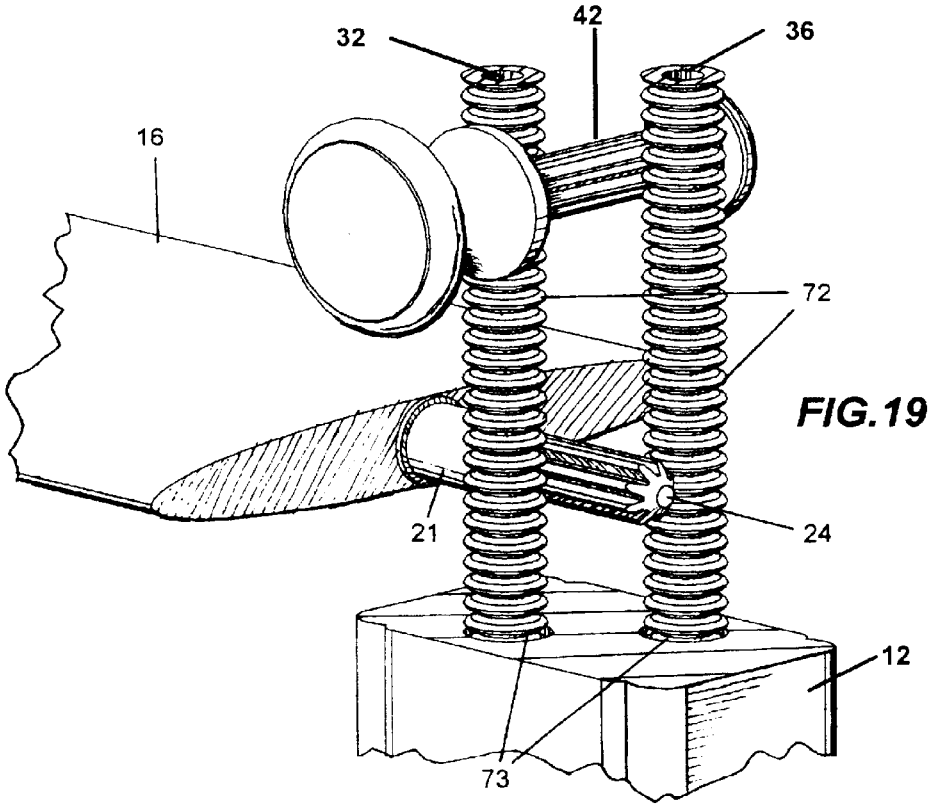
FIG. 19 depicts an alternate preferred embodiment of the device using circular shaped racks geared about their circumference.

Also an optional embodiment of the rack gears is shown in FIG. 19 wherein the first rack gear 32 and second rack gear 36 would each be configured as round components and laterally translate in an appropriately sized and shaped gear channels 73 which would be formed in a stile 12. This embodiment would have one set of gears 72 formed about the circumference thereby forming a first gear surface to cooperatively engage with both the knob stem 42 and louver axle 24 on two side edges. This round embodiment would work substantially the same as the aforementioned rectangular embodiments of the first and second rack gears. FIG. 19 also depicts well the engagement of the knob stem 42 in the configuration of a stile 12 without a channel insert 29 where the first and second rack gears would translate in channels formed in the stile 12 and engage with knob stem 42, which when rotated translates the rack gears and all the communicating louver axles 24.

Figure 20:
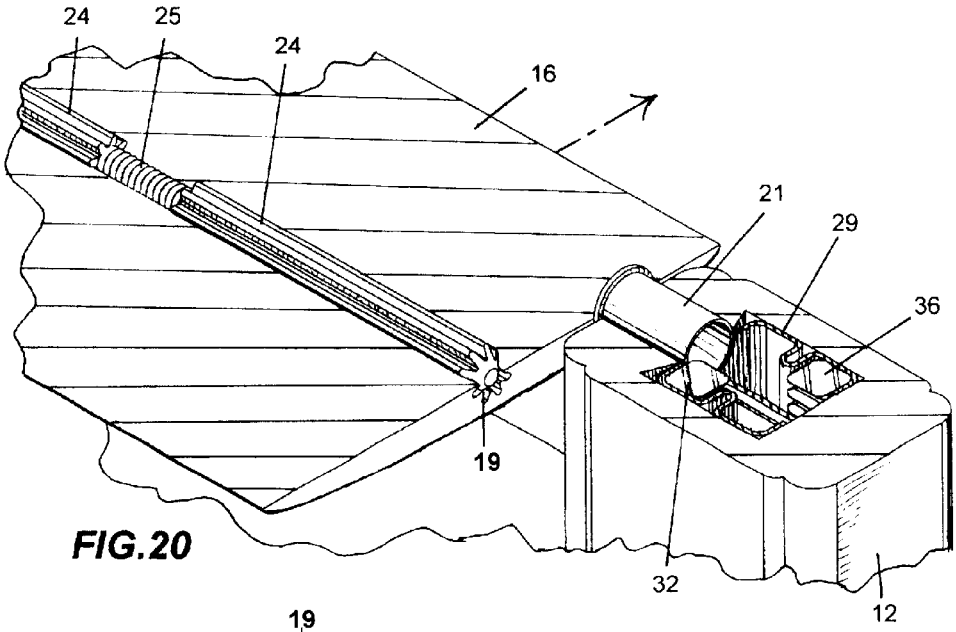
FIG. 20 depicts an assembly view of an alternate preferred embodiment of a louver having louver axles 24 with biased retractable ends in a retracted position.
Figure 21:
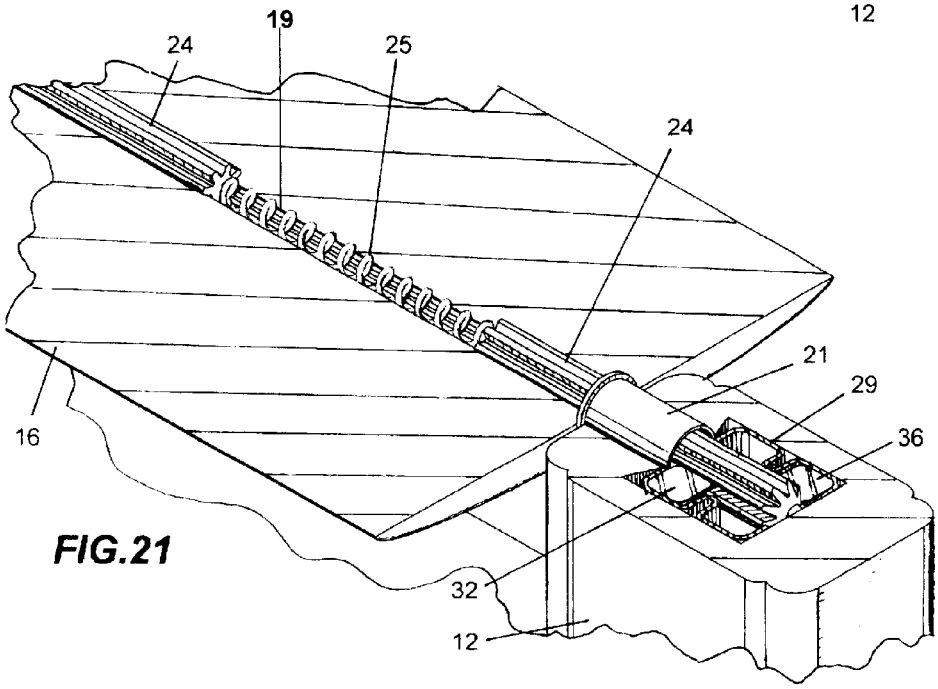
FIG. 21 shows an assembled louver of FIG. 20 showing the louver axles biased to an extended position and cooperatively engaged between channels in a rack gear insert operatively mounted in a stile.

FIGS. 20–21 show an especially useful option for the engagement of the louver axle 24 with the gears operatively housed inside the stile 12. In this embodiment, the distal ends of the louver axle 24 on each side of the louver 16 would be retractable into the axle channel 19 formed in the louver 16. These distal ends of the axle 24 would be biased toward their engagement in the stile 12 by a spring 25 or other means to bias the distal ends of the axle toward the stile 12. This configuration with retractable louver axles 24 would make it especially easy to install and replace louvers 16 from the frames assembled from the stiles 12 and rails 14 since the distal ends of the louver axle 24 can simply be pushed into the louver 16 with the finger or a tool and then allowed to bias out and engage with the stile 12.

Figure 22:
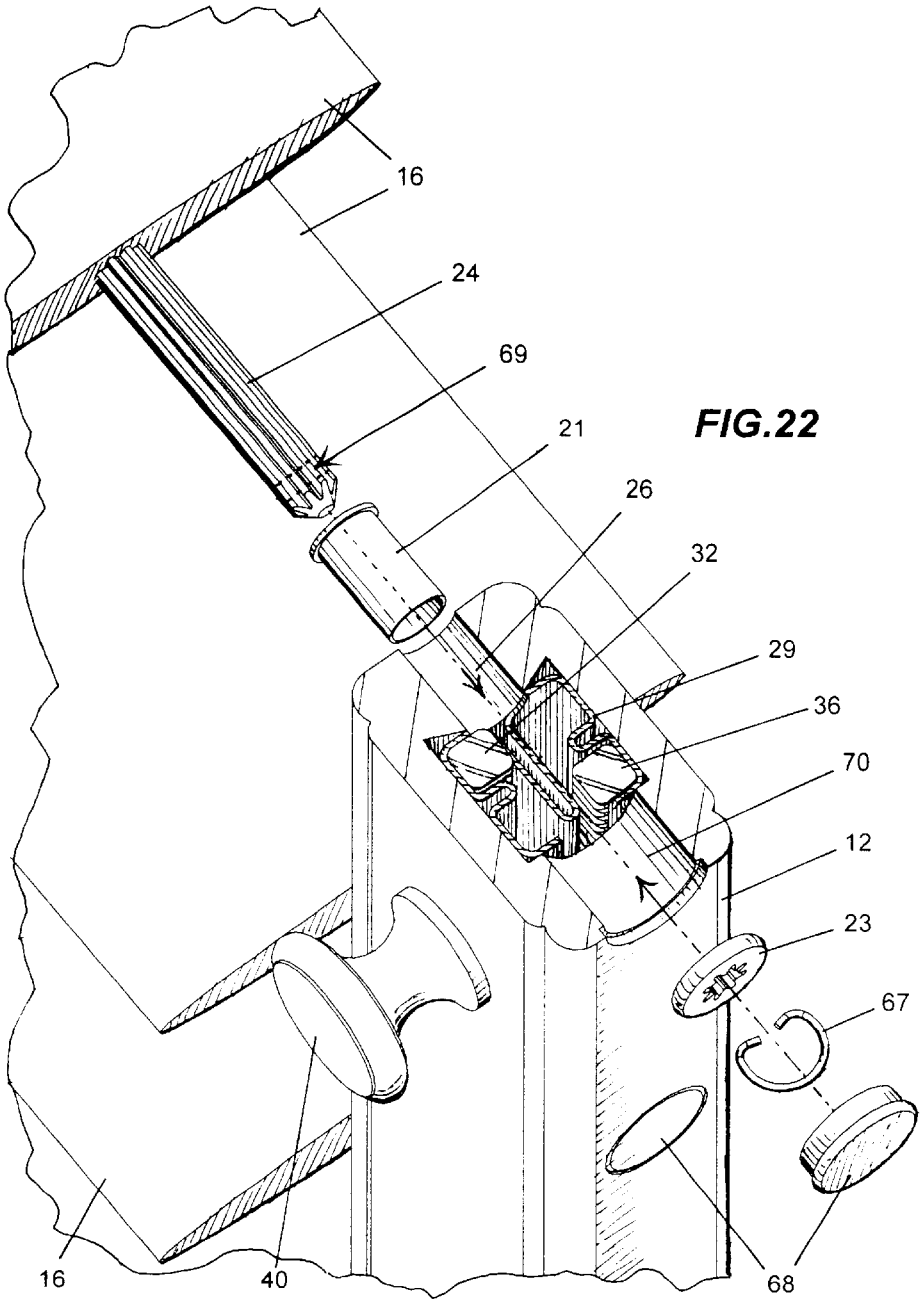
FIG. 22 depicts an alternate preferred embodiment of the device wherein the louver axle has a means for retainment in cooperative engagement with the stile.
Figure 23:
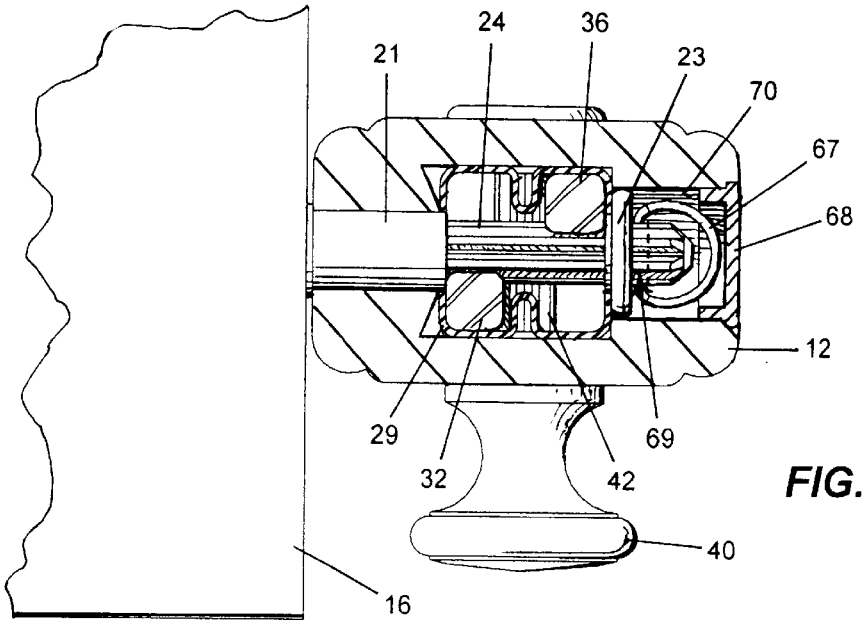
FIG. 23 is a top view of FIG. 22 showing the louver axle with the retainment components engaged at the distal end of the louver axle.

An additional preferred embodiment of the device 10 allows for a secure mount of the louvers 16 in their operative engagement with the stiles 12 and also provides a means to prevent bowing of the stiles 12, especially in larger assembled panels which tend to bow at the middle section of the stiles 12. As best shown in FIGS. 22–23, the distal ends of the louver axle 24 would protrude through their operative engagement with the first rack gear 32 and second rack gear 36, through an open section in the channel insert 29 and into a recess 70 formed in the exterior wall of the stile 12. An outer axle bushing 23 would engage over the louver axle 24 in the recess 70 and against the distal outer surfaces of the channel insert and be retained thereon by a C clip 67 in a clip channel 69 formed adjacent to the end of the axle 24. A clean finish to the exterior wall of the stile 12 is provided by an endcap 68 which frictionally engages with the wall surface of the recess 70. Additionally, the engagement of the C clip 67 on both louver axles 24 maintains the outer axle bushings 23 on both ends a fixed distance from each other and provides a slight pressure to the outside surface of the stiles 12 should they start to bow, thereby providing a means to prevent bowing of the stiles 12. As noted this would be especially helpful on taller frames with long stiles 12 which would naturally tend to bow outwardly, especially over time.

Figure 24:
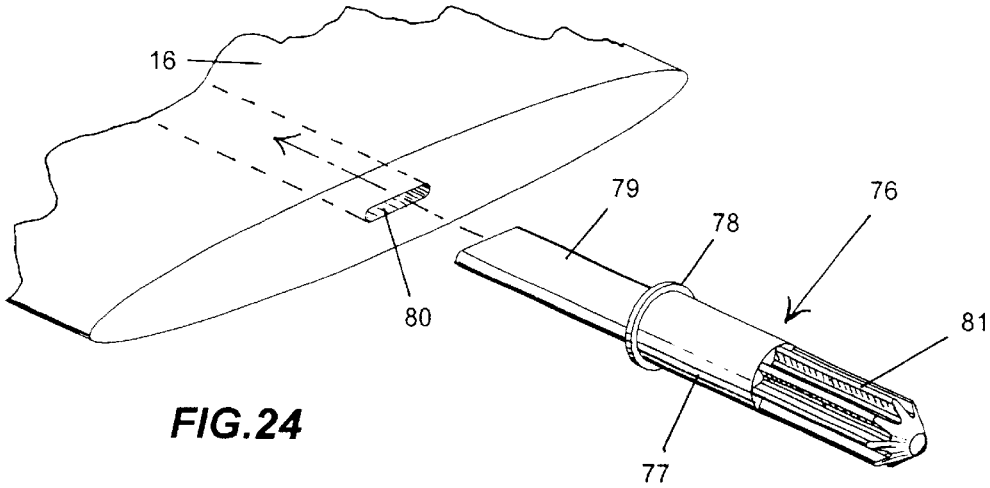
FIG. 24 depicts an alternate preferred embodiment of a louver axle and its engagement with a louver.

An alternative engagement of the louver axle 24 is shown in FIG. 24 which depicts the distal end of a louver 16 having a louver channel 80 sized to cooperatively engage with the circumference of the insertion stem 79 of the alternative louver pin 76 which also has an axle portion 77 and spaceracollar 78 to provide both a means to space the ends of the louvers from the frame and a stop for the lateral translation of the gear portion 81 into its engagement with the first gear rack 32 and second gear rack 36. The preferred embodiment would provide for easy assembly, trimming for size, and thinner louvers 16 due to the flattened louver channel 80 and stem portion 79 engagement.

A still further benefit of the device 10 as described in the aforementioned embodiments, is the ability to supply a modular kit of parts wherein the user could build the device 10 to accommodate the particular window or door for which it is intended. This would be accomplished by providing a kit of different length stiles 12 with pre drilled insertion channels 26. The kit would also feature a plurality of different lengths for the horizontal rails 14 which would easily engage with the stiles 12 using routing grooves 63 in the horizontal rails 14 that engage the joint slots 62 formed in the stiles 12. Of course other means to cooperatively engage the ends of the horizontal rails 14 with the ends of the stiles 12 to form the complete frame, and such is anticipated, however the current scheme using joint slots 62 and routing grooves 63 works quite well and minimizes any tools or mechanical skills that might be required of the user.

By varying the lengths of the stiles 12 and horizontal rails 14 in a kit having a plurality of such lengths, virtually any dimension frame could be formed to fit varying sized windows and doors. One stile 12 would be formed to accommodate the appropriate length first gear rack 32 and second gear rack 36 internally which would also be from a kit of different length racks or may be assembled to the proper length using the mating system shown in FIGS. 17–18. Industry standard knob handles 40 could also be stocked in a variety of styles and mounted on-site to the standard knob stem 42 by using a threaded shaft 37 with threads to match those employed by conventionally available knob handles 40.

The louvers 16 would of course also be provided in varying lengths to be easily insertable and rotatable in their engagements with the insertion channels. The louver pins 24 would work best in this kit form if they were retractable since the frame could just be assembled and then the louvers 16 inserted by retracting the louver pins. The various parts to the kit to form the frame and finished device 10 would be either stocked by a retailer and ordered from a precalculated chart to yield the correct size or they could be sold to users who would inventory a large selection of precut lengths of stiles 12, horizontal rails 14, and louvers 16, to assemble the correct sized frame for the job at hand. Great utility from this kit form is provided both the do it yourself user as well as commercial users in that no cutting would be required to achieve the desired sized frame and the assembled device 10 would also have the benefit of the aforementioned components enhancing the function of the assembled device. Of course, unassembled custom do-it-yourself kits could also be ordered from the factory by customers with one or a few windows who would handle assembly themselves to save money both on manufacturing and shipping costs since no labor for assembly would be required by the manufacturer and since the parts in the kit would ship in a small package rather than as a large assembled and bulky frame.

While all of the fundamental characteristics and features of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. An improved louver rotation apparatus for a louvered shutter having a frame and a plurality of rotating louvers rotationally engaged therein comprising:

a louver frame defined by a pair of elongated stiles attached by a pair of elongated rails;

said elongated stiles each having a top end, a bottom end, an interior side, and exterior side, a front surface and a rear surface and a center axis therethrough;

a first stile of said pair of elongated stiles having a first channel communicating therethrough parallel to said center axis, a second channel communicating therethrough parallel to said center axis, and a channel gap between said first channel and said second channel;

each of said plurality of rotating louvers having louver axles attached at a first end and a second end, said louver axle at said first end rotationally engaged with the second stile of said pair of elongated stiles and said louver axle at said second end protruding into said channel gap through an axle aperture in said first stile;

a first rack gear, said first rack gear having an exterior surface dimensioned for lateral translation inside said first channel and having a first end, a second end, an inward edge on a side facing said channel gap and an outward edge on a side facing said exterior side of said stile;

a second rack gear, said second rack gear having a first end, a second end, an exterior surface dimensioned for lateral translation inside said second channel and having an inner edge on a side facing said channel gap and an interior edge on a side facing said interior side of said stile;

each of said plurality of louver axles having a gear thereon, said gear cooperatively engageable with a first set of gear teeth on said inward edge of said first rack gear, and a second set of gear teeth on said inner edge of said second rack gear;

a knob assembly mounted to said first stile, said knob assembly having a handle communicating with a knob shaft;

said knob shaft cooperatively engaging rack gears formed on at least one of said outward edge of said first rack gear and said interior edge of said second lover rack, whereby a twisting of said knob laterally translates said first and second rack gears rotating said cooperatively engaged louver axles and attached louvers.

2. The improved louver rotation apparatus of claim 1 further comprising a channel insert engageable in an insert channel formed in said first stile; and said first channel and said second channel formed in said channel insert.

3. The improved louver rotation apparatus claim 2 wherein said knob shaft cooperatively engages said rack gears formed on both of said outward edge of said first rack gear and said interior edge of said second rack gear.

4. The improved louver rotation apparatus of claim. 2, additionally comprising a brake means in said knob assembly said brake means disengageable by laterally translating said knob shaft.

5. The improved louver rotation apparatus of claim 4 wherein said brake means in said knob assembly also functions as a clutch providing a determined slippage of said brake means when sufficient force is applied to said louvers and communicated to said brake means.

6. The improved louver rotation apparatus of claim 2 additionally comprising said first rack gear being substantially equal in weight to said second rack gear.

7. The improved louver rotation apparatus claim 2 additionally comprising:

at least one of said louver axles attached to said louvers at a first end and a second end is retractable.

8. The improved louver rotation apparatus of claim 2 further comprising:

at least one of said first end and said second end of said first rack gear configured to cooperatively engage an additional extension piece of said first rack gear whereby said first rack gear may be lengthened by such cooperative engagement of said additional extension piece of rack gear; and at least one of said first end and said second end of said second rack gear configured to cooperatively engage an additional extension piece of said second rack gear whereby said second rack gear may be lengthened by such cooperative engagement of said additional extension piece of said second rack gear.

9. The improved louver rotation apparatus of claim 1 wherein said knob shaft cooperatively engages said rack gears formed on both of said outward edge of said first rack gear and said interior edge of said second rack gear.

10. The improved louver rotation apparatus of claim 1 additionally comprising a brake means in said knob assembly said brake means disengageable by laterally translating said knob shaft.

11. The improved louver rotation apparatus of claim 10 wherein said brake means in said knob assembly also functions as a clutch providing a determined slippage of said brake means when sufficient force is applied to said louvers and communicated to said brake means.

12. The improved louver rotation apparatus of claim 1 additionally comprising said first rack gear being substantially equal in weight to said second rack gear.

13. The improved louver rotation apparatus of claim 1 additionally comprising:

at least one of said louver axles attached to said louvers at a first end and a second end is retractable.

14. The improved louver rotation apparatus of claim 1 further comprising:

at least one of said first end and said second end of said first rack gear configured to cooperatively engage an additional extension piece of, first rack gear whereby said first rack gear may be lengthened by such cooperative engagement of said additional extension piece of rack gear; and at least one of said first end and said second end of said second rack gear configured to cooperatively engage an additional extension piece of said second rack gear whereby said second rack gear may be lengthened by such cooperative engagement of said additional extension piece of said second rack gear.

15. The improved louver rotation apparatus of claim 1 wherein said frame may be assembled from a kit wherein:

said pair or elongated stiles are substantially equal in length and chosen from a said skit containing a plurality of different length stiles;

said pair of elongated rails is substantially equal in length and chosen from kit containing a plurality of different length rails;

means for cooperative engagement of said pair of elongated rails to said pair of elongated stiles; and said plurality of rotating louvers substantially equal in length and chosen from kit containing a plurality matching sets of louvers each matching set being of different lengths.

16. An improved louver rotation apparatus for use in combination with a louvered shutter having a frame and a plurality of rotating louvers rotationally engaged therein comprising:

a louver frame defined by a pair or elongated stiles attached by a pair of elongated rails;

said elongated stiles each having a top end, a bottom end, an interior side, and exterior side, a front surface and a rear surface and a center axis therethrough;

a first stile of said pair of elongated stiles have a first channel communicating therethrough parallel to said center axis;

each of said plurality of rotating louvers having louver axles attached at a first end and a second end, said louver axle at said first end rotationally engaged with the second stile of said pair of elongated stiles, said louver axle at said second end protruding into an aperture in said first stile;

a first rack gear, said first rack dimensioned for lateral translation inside said first channel and having a first end;

each of said plurality of louver axles having a gear thereon, said gear cooperatively engageable with a first set of gear teeth on said inward edge of said first rack gear;

a knob assembly mounted to said first stile, said knob assembly having a handle communicating with a knob shaft protruding from one of said front surface or said rear surface of said first stile;

said knob shaft communicating with a knob gear cooperatively engaging rack gears formed on said outward edge of said first rack gear; whereby twisting of said knob is communicated to said knob gear which thereby laterally translates said first rack rotating said cooperatively engaged louver axles and attached louvers.

17. The improved louver rotation apparatus of claim 16 additionally comprising:

a channel insert engageable in an insert channel formed in said first stile; and said first channel formed in said channel insert.

18. The improved louver rotation apparatus of claim 17 additionally comprising a brake means in said knob assembly, said brake means disengageable by laterally translating said knob shaft.

19. The improved louver rotation apparatus of claim 18 wherein said brake means in said knob assembly also functions as a clutch providing a determined slippage of said brake means when sufficient force is applied to said louvers and communicated to said brake means.

20. The improved louver rotation apparatus of claim 16 additionally comprising a brake means in said knob assembly, said brake means disengageable by laterally translating said knob shaft.

21. The improved louver rotation apparatus of claim 20 wherein said brake means in said knob assembly also functions as a clutch providing a determined slippage of said brake means when sufficient force is applied to said louvers and communicated to said brake means.

22. The improved louver rotation apparatus of claim 14 wherein at least one of said louver axles on each of said plurality of rotating louvers is retractable.

23. An improved louver rotation apparatus for use in combination with a louvered shutter having a frame defined by a pair of elongated stiles attached to a pair of elongated rails and a plurality of rotating louvers rotationally engaged therein comprising:

a first stile of said pair of elongated stiles having a first channel communicating therethrough parallel to a center axis;

each of said plurality of rotating louvers having first louver axles attached at a first end and second louver axles at a second end;

said second louver axle rotationally engaged with the second stile of said pair of elongated stiles;

a first rack gear, said first rack gear having an exterior surface dimensioned for lateral translation inside said first channel and having a first end, a second end, an inward edge; and an outward edge;

means for engagement of said first louver axle with said inward edge wherein lateral translation of said first rack gear rotates said first louver axle;

a knob assembly mounted to said first stile, said knob assembly having a handle communicating with a knob shaft;

means of cooperative engagement of said knob shaft with said outward edge of said first rack whereby a twisting of said knob laterally translates said first gear rack thereby rotating said first louver axles and said attached louvers.

24. The improved louver rotation apparatus of claim 23 further comprising:

a second channel communicating through said second stile parallel to a center axis;

a second rack gear, said second rack gear having an exterior surface dimensioned for lateral translation inside said second channel and having a first end, a second end, an inner edge; and an outer edge; and means for engagement of said first louver axle with said inner edge of said second rack gear wherein lateral translation of said second rack gear rotates said second louver axles.

25. The improved louver rotation apparatus of claim 24 further comprising:

means of cooperative engagement of said knob shaft with said outer edge of said second gear rack whereby a twisting of said knob laterally translates said second gear rack in said second channel.

26. The improved louver rotation apparatus of claim 24 further comprising:

said first rack gear and said second rack gear having substantially equal weights to thereby provide a means to stabilize said louvers by imparting equal downward force to said louver axles.

27. The improved louver rotation apparatus of claim 23 further comprising:

at least one of said first louver axles and said second louver axles attached to said plurality of rotating louvers being retractable.

28. The improved louver rotation apparatus of claim 23 further comprising:

means for engagement of said first louver axle with said first stile and said second louver axle with said second stile thereby provide a means to prevent bowing of said first stile and said second stile.

29. The improved louver rotation apparatus of claim 23 additionally comprising a brake means in said knob assembly, said brake means disengageable by laterally translating said knob shaft.

30. The improved louver rotation apparatus of claim 29 wherein said brake means in said knob assembly also functions as a clutch providing a determined slippage of said brake means when sufficient force is applied to said louvers and communicated to said brake means.

* * * * *